US007658469B2

(12) United States Patent
Hino et al.

(10) Patent No.: US 7,658,469 B2
(45) Date of Patent: Feb. 9, 2010

(54) INK JET HEAD AND ITS MANUFACTURE METHOD

(75) Inventors: Etsuko Hino, Tokyo (JP); Norio Ohkuma, Tokyo (JP); Helmut Schmidt, Saarbrucken (DE); Carsten Becker-Willinger, Saarbrucken (DE); Pamela Kalmes, Quierschied (DE)

(73) Assignee: Canon Kabushiki Kaisha, Tokyo (JP)

( * ) Notice: Subject to any disclaimer, the term of this patent is extended or adjusted under 35 U.S.C. 154(b) by 275 days.

(21) Appl. No.: 10/541,767

(22) PCT Filed: Jul. 22, 2003

(86) PCT No.: PCT/JP03/09246

§ 371 (c)(1),
(2), (4) Date: Jul. 8, 2005

(87) PCT Pub. No.: WO2005/007411

PCT Pub. Date: Jan. 27, 2005

(65) Prior Publication Data

US 2006/0132539 A1 Jun. 22, 2006

(51) Int. Cl.
*B41J 2/135* (2006.01)

(52) U.S. Cl. ..... 347/47; 427/470; 427/508; 427/515; 528/42

(58) Field of Classification Search ..... 427/470, 427/508, 515; 528/42; 347/47
See application file for complete search history.

(56) References Cited

U.S. PATENT DOCUMENTS 5,010,356 A * 4/1991 Albinson ..... 347/45
5,218,376 A 6/1993 Asai
5,478,606 A * 12/1995 Ohkuma et al. ..... 427/555
5,644,014 A 7/1997 Schmidt et al.
5,730,889 A 3/1998 Miyagawa et al.
5,786,832 A 7/1998 Yamanaka et al.
6,139,761 A 10/2000 Ohkuma
6,155,673 A 12/2000 Nakajima et al.
6,283,578 B1 9/2001 Popall et al.
6,305,080 B1 10/2001 Komuro et al.
6,455,112 B1 9/2002 Ohkuma et al.
6,488,364 B1 12/2002 Nakajima et al.
6,766,579 B2 7/2004 Ohkuma
2002/0001016 A1* 1/2002 Aono et al. ..... 347/47

(Continued)

FOREIGN PATENT DOCUMENTS

EP 0 587 667 9/1995

(Continued)

OTHER PUBLICATIONS

Chinese Office Action dated Apr. 6, 2007, issued in corresponding Chinese patent application No. 03825983.4, with English-language translation.

(Continued)

*Primary Examiner*—Manish S Shah
*Assistant Examiner*—Laura E Martin
(74) *Attorney, Agent, or Firm*—Fitzpatrick, Cella, Harper & Scinto

(57) ABSTRACT

An ink jet head is formed of a nozzle material composed of a condensation product containing a hydrolysable silane compound having a fluorine-containing group and a photo-polymerizable resin composition.

12 Claims, 2 Drawing Sheets

U.S. PATENT DOCUMENTS

| | | | | |
|---|---|---|---|---|
| 2002/0101477 | A1* | 8/2002 | Hiroyuki et al. | 347/45 |
| 2002/0193504 | A1* | 12/2002 | Brueck et al. | 524/588 |

FOREIGN PATENT DOCUMENTS

| | | |
|---|---|---|
| EP | 1 085 031 A | 3/2001 |
| JP | 4-10940 | 1/1992 |
| JP | 4-10941 | 1/1992 |
| JP | 4-10942 | 1/1992 |
| JP | 6-286149 | 10/1994 |
| JP | 8-290572 | 11/1996 |
| JP | 10-505870 | 6/1998 |
| JP | 11-322896 | 11/1999 |
| JP | 11-335440 | 12/1999 |
| JP | 2000-26575 | 1/2000 |
| JP | 2000-105152 | 4/2000 |
| JP | 3143307 | 12/2000 |
| JP | 3306442 | 5/2002 |
| JP | 2002-292878 | 10/2002 |
| KR | 2006-0036465 | 4/2006 |
| WO | 2005/007413 | 1/2005 |

OTHER PUBLICATIONS

English-language translation of Korean Office Action dated Dec. 7, 2006 issued in corresponding foreign patent application.

Official Communication dated Oct. 17, 2007, issued in corresponding EP application No. 03 741 523.9.

* cited by examiner

INK JET HEAD AND ITS MANUFACTURE METHOD

TECHNICAL FIELD

This invention is in an ink jet head and its manufacture method.

BACKGROUND ART

Recently, the technical development to the improvement in a performance of smaller droplet, higher drive frequency and more number of nozzle is continued in order to make the record characteristic more advanced in an ink jet record system. And image recording is performed by ejecting liquid from an ejection opening as small droplet which adheres to the recording medium typified by paper.

Here, a surface treatment is becoming more important to maintain ejecting performance by keeping ejecting opening surface as same condition at any time. Moreover, it is common to wipe off the ink which remained on the surface by e.g. rubber blade periodically to maintain the condition of the ejecting opening surface in an ink jet head. A liquid repellent material is demanded for easy wiping, and wiping durability.

Moreover, when the liquid repellent layer is prepared on the surface, the liquid repellent layer needs to adhere to its lower layer, and the problem of peeling off of liquid repellent layer may occur. Since the ink used for an ink jet head is not neutral in many cases, it is also required that the liquid repellent material should have durability against ink and have adhesion power to a nozzle. In addition to preventing peeling, from a viewpoint of simplification of manufacturing process and cost reduction, the process is desired that the nozzle material and liquid repellent layer is prepared all at once. That is, nozzle material itself is desired to have liquid repellency.

Various methods have so far been indicated as the liquid repellent processing on the surface of a nozzle in the ink jet head. However, most of them were just the surface treatment of the formed nozzle, and the nozzle material itself did not have the liquid repellent nature.

The surface treatment method which used the fluoride containing silane compound is indicated in Japanese Patent Publication No 10-505870 and U.S. Pat. No. 6,283,578.

However, these surface treatments were aimed at liquid repellent nature grant, and were not those in which the liquid repellent material itself has patterning nature. Moreover, the liquid repellent materials that had photosensitivity were indicated by Japanese Patent Application Laid-Open No. 11-322896, Japanese Patent Application Laid-Open No. 11-335440, and Japanese Patent Application Laid-Open No. 2000-26575. These materials could not form the solid structure like a nozzle.

When the fluorine-containing compound which is a typical liquid repellent material is added to resin, it is well-known phenomenon that fluorine-containing group is arranged in the surface for its low surface energy, and presenting liquid repellency.

However, since fluorine-containing compounds generally have low dissolubility to other resin, it was difficult to mix with photosensitive resin and to use together.

Although the block copolymer having fluorine-containing group was indicated in Japanese Patent Application Laid-Open No. 2002-105152 as a coating composition, it could not be applied to the high-precision patterning like nozzle forming. Japanese Patent Application Laid-Open No. 2002-292878 referred to the orifice plate having nozzle structure, which was made of fluorine-containing resin. Since fluorine-containing resin did not have photosensitive characteristic corresponding to patterning by photo-lithography, the nozzle had to be formed by dry etching etc. Furthermore, the inside of ink passage of a nozzle needs to be hydrophilic in order to obtain the ejecting performance, hydrophilic processing needed to be performed inside of the ink passage and the adhesion side with basis material and so on.

Cationically polymerizable resin composition, which included fluorine-containing compounds, was indicated by Japanese Patent Application Laid-Open No. 8-290572. However, the purpose of this invention was the rate reduction of water absorption of material, not liquid repellency. Since the compound in this invention has hydroxyl group for dissolubility with resin composition, the composition did not show liquid repellency.

U.S. Pat. No. 5,644,014, EP B1 587667 and Japanese Patent Publication No. 3306442 referred to the liquid repellent material comprising hydrolysable silane compounds which had fluorine-containing group. Although the above-mentioned material is indicating the photo curability which was derived from photo radical polymerization, it is not mentioned about pattern formation using photo lithography technology nor the application to an ink jet head.

DISCLOSURE OF THE INVENTION

This invention is made in view of above-mentioned many points, carried out to provide liquid repellent material of an ink jet head, which has high liquid repellency, high durability against the wiping (to maintain high liquid repellency) and the ease of wiping simultaneously, and which realizes high-quality image recording.

The further purpose is to offer a manufacturing method of ink jet head which realizes the improvement in accuracy of the ejection outlet portion of a nozzle and a simple manufacturing process, by giving liquid repellent nature to the above-mentioned nozzle material itself, and making a liquid repellent processing process unnecessary.

The present invention designed to attain the above-mentioned objectives is an ink jet head, wherein the nozzle material comprises condensation product of hydrolysable silane compound having fluorine-containing group and photo-polymerizable resin composition.

Another present invention designed to attain the above-mentioned objectives is a method of manufacturing ink jet head, which is forming the nozzle having liquid repellent nature on the surface thereof by pattern-exposure and developing a nozzle material on the substrate, wherein the nozzle material comprises condensation product of a hydrolysable silane compound having fluorine-containing group and photo-polymerizable resin composition.

That is, the compatibility of liquid repellent material and photo resist composition is improved by using the above-mentioned composition. Thus, good patterning characteristic corresponding to formation of a high precision structure like a nozzle, high liquid repellency and high wiping durability are realized without liquid repellent processing on the surface.

BEST MODE FOR CARRYING OUT THE INVENTION

Figure 1:
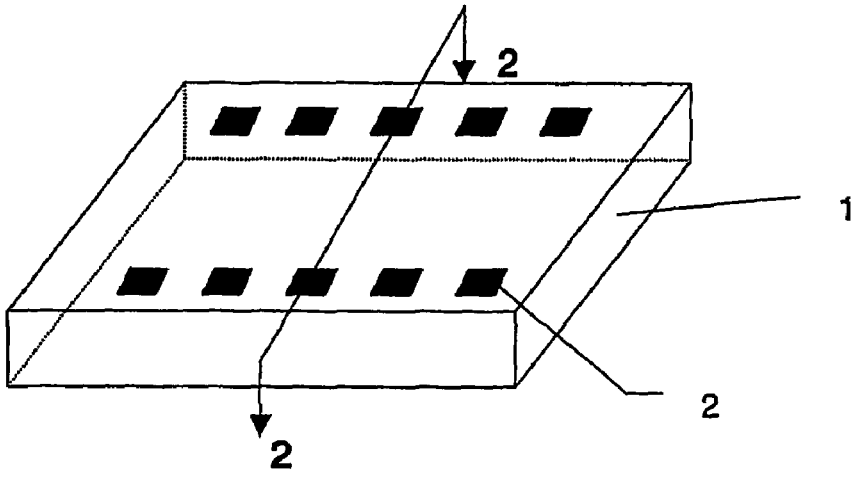
FIG. 1 is a perspective view of a substrate to be used for manufacturing the ink jet head of this invention.

The present invention will be described in detail.

These inventors found out that the nozzle surface which has high liquid repellency and high wiping durability even if liquid repellent processing was not performed, as a result of using the composition comprising condensation product containing hydrolysable silane compound having fluorine-containing group and photo-polymerizable resin composition as the nozzle material of the ink jet head.

According to the composition of the nozzle material of this invention, the cured material has the siloxane frame (Inorganic frame) formed from the hydrolysable silane, and a frame (Organic frame: ether bond when using the epoxy group) by curing the cationically polymerizable group. Thereby, a cured material becomes into the so-called organic and inorganic hybrid cured material, and durability against wiping and its recording liquid is improved by leaps and bounds. That is, it is thought that its strength as a film improves and the wiping resistance improves compared with liquid repellent layer formed only by the siloxane frame since liquid repellent layer of this invention has an organic frame.

Furthermore, since it is organic and inorganic hybrid material, the compatibility of fluorine-containing compound and photo polymerizable resin composition, which was a problem conventionally, is improved. And fluorine-containing compound which has low surface free energy is able to mix with photo-polymerizable resin composition as nozzle material.

Subsequently, the composition material of this invention will be described concretely. The hydrolysable silane compound having fluorine-containing group, which is one of the starting materials of the condensation product, is indispensable to have one or more non-hydrolysable fluorine-containing group and hydrolysable substituent.

As the non-hydrolysable fluorine-containing group, straight-chain or blanched-chain fluoro-carbon group can be referred. In the case of blanched-chain fluoro-carbon group, the terminal or the side chain is preferred to be trifluoromethyl or pentafluoroethyl group. Owing to its surface free energy, fluorine-containing group have tendency to arrange in the surface.

On the other hand, fluorine-containing group of the fluorosilane contains generally at least 1, preferably at least 3 and in particular at least 5 fluorine atoms, and generally not more than 30, more preferably not more than 25 fluorine atoms which are attached to one or more carbon atoms. It is preferred that said carbon atoms are aliphatic including cycloaliphatic atoms. Further, the carbon atoms to which fluorine atoms are attached are preferably separated by at least two atoms from the silicon atom, which are preferably carbon and/or oxygen atoms, e.g. a $C_{1-4}$ alkylene or a $C_{1-4}$ alkylenoxy, such as an ethylene or ethylenoxy linkage.

Preferred hydrolysable silanes having a fluorine-containing group are those of general formula (1):

$$R_fSi(R)_bX_{(3-b)} \quad (1)$$

wherein $R_f$ is a non-hydrolysable substituent having 1 to 30 fluorine atoms bonded to carbon atoms, R is a non-hydrolysable substituent, X is a hydrolysable substituent, and b is an integer from 0 to 2, preferably 0 or 1 and in particular 0.

In general formula (1) the hydrolysable substituents X, which may be identical or different from one another, are, for example, hydrogen or halogen (F, Cl, Br or I), alkoxy (preferably $C_{1-6}$ alkoxy, such as methoxy, ethoxy, n-propoxy, isopropoxy and n-butoxy, sec-butoxy, isobutoxy, and tert-butoxy), aryloxy (preferably $C_{6-10}$ aryloxy, such as phenoxy), acyloxy (preferably $C_{1-6}$ acyloxy, such as acetoxy or propionyloxy), alkylcarbonyl (preferably $C_{2-7}$ alkycarbonyl, such as acetyl). Preferred hydrolysable substituents are halogen, alkoxy groups, and acyloxy groups. Particularly preferred hydrolysable substituents are $C_{1-4}$ alkoxy groups, especially methoxy and ethoxy.

The non-hydrolysable substituent R, which may be identical to or different from one another, may be a non-hydrolysable substituent R containing a functional group or may be a non-hydrolysable substituent R without a functional group. In general formula (I) the substituent R, if present, is preferably a group without a functional group.

The non-hydrolysable substituent R without a functional group is, for example, alkyl (e.g., $C_{1-8}$ alkyl, preferably $C_{1-6}$ alkyl, such as methyl, ethyl, n-propyl, isopropyl, n-butyl, s-butyl and t-butyl, pentyl, hexyl, and octyl), cycloalkyl (e.g. $C_{3-8}$ cycloalkyl, such as cyclopropyl, cyclopentyl or cyclohexyl), alkenyl (e.g. $C_{2-6}$ alkenyl, such as vinyl, 1-propenyl, 2-propenyl and butenyl), alkynyl (e.g. $C_{2-6}$ alkynyl, such as acetylenyl and propargyl), cycloalkenyl and cycloalkynyl (e.g. $C_{2-6}$ alkenyl and cycloalkynyl), aryl (e.g. $C_{6-10}$ aryl, such as phenyl and naphthyl), and corresponding arylalkyl and alkylaryl (e.g. $C_{7-15}$ arylalkyl and alkylaryl, such as benzyl or tolyl). The substituent R may contain one or more substituents, such as halogen, alkyl, aryl, and alkoxy. In formula (1) R when present is preferably methyl or ethyl.

A particular preferred substituent $R_f$ is $CF_3(CF_2)_n$-Z- where n and Z are defined as defined in general formula (4) below.

$$CF_3(CF_2)_n\text{-}Z\text{-}SiX_3 \quad (4)$$

wherein X is as defined in general compound 1 and preferably is methoxy or ethoxy, Z is a divalent organic group, and n is an integer from 0 to 20, preferably 3 to 15, more preferably 5 to 10. Preferably, Z contains not more than 10 carbon atoms and Z is more preferably a divalent alkylene or alkyleneoxy group having not more than 6 carbon atoms, such as methylene, ethylene, propylene, butylene, methylenoxy, ethyleneoxy, propylenoxy, and butylenoxy. Most preferred is ethylene.

Specific examples are $CF_3CH_2CH_2SiCl_2(CH_3)$, $CF_3CH_2CH_2SiCl(CH_3)_2$, $CF_3CH_2CH_2Si(CH_3)(OCH_3)_2$, $CF_3CH_2CH_2SiX_3$, $C_2F_5CH_2CH_2SiX_3$, $C_4F_9CH_2CH_2SiX_3$, n-$C_6F_{13}CH_2CH_2SiX_3$, n-$C_8F_{17}CH_2CH_2SiX_3$, n-$C_{10}F_{21}CH_2CH_2SiX_3$ (X=$OCH_3$, $OC_2H_5$ or Cl); i-$C_3F_7O$—$CH_2CH_2CH_2$—$SiCl_2(CH_3)$, n-$C_6F_{13}$—$CH_2CH_2$—$SiCl(OCH_2CH_3)_2$, n-$C_6F_{13}$—$CH_2CH_2$—$SiCl_2(CH_3)$ and n-$C_6F_{13}$—$CH_2CH_2$—$SiCl(CH_3)_2$. Particularly preferred are $C_2F_5$—$C_2H_4$—$SiX_3$, $C_4F_9$—$C_2H_4$—$SiX_3$, $C_6F_{13}$—$C_2H_4$—$SiX_3$, $C_8F_{17}$-$C_2H_4$—$SiX_3$, $C_{10}F_{21}$—$C_2H_4$—$SiX_3$ and $C_{12}F_{25}$—$C_2H_4$—$SiX_3$, where X is a methoxy or ethoxy group.

Furthermore, the inventors have found that by using at least two different hydrolysable silanes having a fluorine-containing group of a different kind unexpectedly improved results are obtained, especially with regard to liquid repellent properties, wiping durability, and resistance to chemicals such as recording liquid. The silanes used preferably differ in the number of fluorine atoms contained therein or in the length (number of carbon atoms in the chain) of the fluorine-containing substituent.

Although the reason for these improvements is not clear, the fluoroalkyl groups of different length are believed to cause a structural arrangement of higher density, since the fluoroalkyl group should take an optimal arrangement in the uppermost surface. For example, in the case where at least two of $C_6F_{13}$—$C_2H_4$—$SiX_3$, $C_8F_{17}$—$C_2H_4$—$SiX_3$, and $C_{10}F_{21}$—$C_2H_4$—$SiX_3$ (X as defined above) are used together, the high fluorine concentration in the uppermost surface is represented by fluoroalkyl groups of different length which results in the named improvements compared to the addition of a single fluorosilane.

Moreover, it is suitable to use together different silane compound from above-mentioned silane compound having fluorine-containing group, i.e., silane compound not having fluorine-containing group, as starting materials of condensation reaction. In that case, adjustment of fluorine content, reaction control and control of the physical property become easy.

Although this invention uses together above-mentioned condensation product and photo-polymerization composition, it is also suitable for it from a viewpoint of durability to introduce a polymerizable group into condensation product.

As polymerizable substituent of hydrolysable silane compound, radical polymerizable group and cationically polymerizable group can be used. From a viewpoint of alkali ink resistance, cationically polymerizable group is desirable here.

A preferred hydrolysable silane having a cationically polymerizable group is a compound of general formula (2):

$$R_cSi(R)_bX_{(3-b)} \quad (2)$$

wherein $R_c$ is a non-hydrolysable substituent having a cationically polymerizable group, R is a non-hydrolysable substituent, X is a hydrolysable substituent, and b is an integer from 0 to 2.

As a cationically polymerizable organic group, a cyclic ether group represented epoxy group and oxetane group, a vinyl ether group etc. can be used. In the viewpoint of availability and reaction control, an epoxy group is preferable.

Specific examples of said substituent Rc are glycidyl or glycidyloxy $C_{1-20}$alkyl, such as γ-glycidylpropyl, β-glycidoxyethyl, δ-glycidoxybutyl, ϵ-glycidoxypentyl, ω-glycidoxyhexyl, and 2-(3,4-epoxycyclohexyl)ethyl. The most preferred substituents $R_c$ are glycidoxypropyl and epoxycyclohexylethyl.

Specific examples of corresponding silanes are g-glycidoxypropyltrimethoxysilane (GPTS), g□glycidoxypropyltriethoxysilane (GPTES), epoxycyclohexylethyltrimethoxysilane, and epoxycyclohexylethyltriethoxysilane. However, the invention is not limited to the above-mentioned compounds.

Furthermore, in addition to the hydrolysable silane compounds having fluorine-containing group or photo-polymerizable group, a hydrolysable silane having at least one alkyl substituent, a silane having at least one aryl substituent, or a silane having no non-hydrolysable substituent can be used together for controlling the physical properties of the liquid repellent layer.

Preferred further hydrolysable silanes, which may be used in the present invention are those of general formula (3):

$$R_aSiX_{(4-a)} \quad (3)$$

wherein R is a non-hydrolysable substituent selected from substituted or unsubstituted alkyl and substituted or unsubstituted aryl, X is a hydrolysable substituent, and a is an integer from 0 to 3.

Tetramethoxysilane, tetraethoxysilane, tetrapropoxysilane, methyltrimethoxysilane, methyltriethoxysilane, methyltripropoxysilane, ethyltrimethoxysilane, ethyl triethoxysilane, ethyltripropoxysilane, propyltrimethoxysilane, propyltriethoxysilane, propyltripropoxysilane, phenyltrimethoxysilane, phenyltriethoxysilane, phenyltripropoxysilane, diphenyldimethoxysilane, diphenyldiethoxysilane, dimethyldimethoxysilane, dimethyldiethoxysilane, etc. are specifically mentioned. This invention is not limited to the above-mentioned compound.

The proportion of the silanes used for preparing the condensation product is selected according to the application desired and is within the knowledge of a person skilled in the art of manufacture of inorganic polycondensates. It has been found that the hydrolysable silanes having a fluorine-containing group are appropriately used in amounts in the range from 0.5 to 20% by mole, preferably 1 to 10% by mole, based on the total amount of hydrolysable compounds used. Within these ranges a high liquid repellency as well as a very uniform surface are obtained. The latter is especially important for photo-curing and/or recording applications involving irradiation since the surface obtained often tends to have concave and/or convex forms which affect light scattering. Thus, the above-mentioned ranges provide highly repellent, even surfaces which are especially suited for photo-curing and/or recording applications.

The proportion between the hydrolysable silane having the cationically polymerizable group and the further hydrolysable silane is preferably in the range of 10:1 to 1:10.

Generally, the condensation product of the above-mentioned hydrolysable silanes is prepared by hydrolysis and condensation of said starting compounds in accordance with the sol-gel method, which is known to those skilled in the art. The sol-gel method generally comprises the hydrolysis of said hydrolysable silanes, optionally aided by acid or basic catalysis. The hydrolysed species will condense at least partially. The hydrolysis and condensation reactions cause the formation of condensation products having e.g. hydroxy groups and/or oxo bridges. The hydrolysis/condensation product may be controlled by appropriately adjusting parameters, such as e.g. the water content for hydrolysis, temperature, period of time, pH value, solvent type, and solvent amount, in order to obtain the condensation degree and viscosity desired.

Moreover, it is also possible to use a metal alkoxide in order to catalyse the hydrolysis and to control the degree of condensation. For said metal alkoxide, the other hydrolysable compounds defined above may be used, especially an aluminum alkoxide, a titanium alkoxide, a zirconium alkoxide, and corresponding complex compounds (e.g. with acetyl acetone as the complex ligand) are appropriate.

The composite coating composition further comprises at least one cationically polymerizable organic resin, which is preferably cationically photo-polymerizable. Since an organic frame is formed by cationic polymerization (typically ether bond formation), re-hydrolysis of a siloxane frame is subdued, and the resistance to recording liquid (typically alkaline ink) is improved. Meanwhile in this invention, the inorganic frame of siloxane shows high mechanical durability against wiping. As a result of coexistence of the organic frame and inorganic frame, it is surprisingly improved both of recording liquid resistance and wiping durability.

The cationically polymerizable resin is preferably a cationically polymerisable epoxy resin known to those skilled in the art. The cationically polymerisable resin can also be any other resin having electron rich nucleophilic groups such as oxetane, vinylether, vinylaryl or having heteronuclear groups such as aldehydes, ketones, thioketones, diazoalkanes. Of special interest are also resins having cationically polymerisable ring groups such as cyclic ethers, cyclic thioethers, cyclic imines, cyclic esters (lactone), 1,3-Dioxacycloalkane (ketale), spiroorthoesters or spiroorthocarbonates.

The term "cationically polymerizable resin" herein refers to an organic compound having at least 2 cationically polymerizable groups including monomers, dimers, oligomers or polymers or mixtures thereof.

Accordingly, the cationically polymerizable organic resin preferably comprises epoxy compounds, such as monomers, dimers, oligomers, and polymers. The epoxy compound used for the coating composition is preferably solid state at room temperature (approx. 20° C.), more preferably it has a melting point of 40° C. or higher.

Examples of said epoxy compound for the coating composition are epoxy resins having at least one of the structural units (1) and (2):

(1)

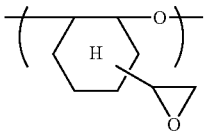

(2)

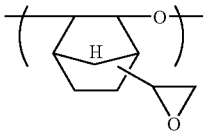

Further examples are epoxy resins of the bisphenol type (e.g. Bisphenol-A-diglycidylether (Araldit GY 266 (Ciba)), Bisphenol-F-diglycidylether) and epoxy resins of the novolak type, such as phenol novolak (e.g. Poly [(phenyl-2, 3-epoxypropylether)-ω-formaldehyde]) and cresol novolak as well as cycloaliphatic epoxy resins such as e.g. 4-Vinylcyclohexene-diepoxide, 3,4-Epoxycyclohexane-carboxylic-acid-(3,4-epoxycyclohexylmethylesther) (UVR 6110, UVR 6128 (Union Carbide)). Additional examples are Triphenylolmethanetriglycidylether, N,N-Bis-(2, 3-epoxypropyl)-4-(2,3-epoxypropoxy)-aniline and Bis-{4-[bis-(2,3-epoxypropyl)-amino]-phenyl} methane.

Concerning the epoxy resin compound, epoxy equivalent is preferably less than 2000, more preferably less than 1000. If epoxy equivalent exceeds 2000, the degree of cross-linking decreases in the curing reaction, and some problems may occur, decline of Tg, adhesion power to a substrate and ink-resistance etc.

The coating composition according to the present invention further contains a cationic initiator. The specific type of the cationic initiator used may e.g. depend on the type of cationically polymerizable groups present, the mode of initiation (thermal or photolytic), the temperature, the type of radiation (in the case of photolytic initiation) etc.

Suitable initiators include all common initiator systems, including cationic photo-initiators, cationic thermal initiators, and combinations thereof.

Cationic photo-initiators are preferred. Representative of cationic initiators that can be used include onium salts, such as sulfonium, iodonium, carbonium, oxonium, silecenium, dioxolenium, aryldiazonium, selenonium, ferrocenium and immonium salts, borate salts and corresponding salts of Lewis acids $AlCl_3$, $TiCl_4$, $SnCl_4$, compounds containing an imide structure or a triazine structure, azo compounds, perchloric acid, and peroxides. As cationic photoinitiators, aromatic sulfonium salts or aromatic iodonium salts are advantageous in view of sensitivity and stability.

A mixing ratio by weight of condensation product and cationically polymerizable organic resin is preferably 0.001-1:1, more preferably it is 0.005-0.5:1.

When the mixing ratio of condensation product is lower, the liquid repellency of the surface is not sufficient. And when higher, photo-patterning characteristic and/or adhesion power to a substrate may decrease.

Generally, in liquid repellent layer of an ink jet head, it is desirable that it has a flat surface with little unevenness. The liquid repellent layer, which has unevenness, shows high liquid repellency (high advancing contact angle or high static contact angle) against recording liquid droplet. However when rubbing liquid repellent layer in wiping operation etc with recording liquid, recording liquid remains in a concave portion and the liquid repellency of liquid repellent layer may be spoiled as a result. This phenomenon is remarkable in the embodiment that recording liquid contains pigment, i.e., a color material particle, since the color material particle enters and adheres to the concave portion. Therefore, as for the surface roughness Ra, which indicates the unevenness of liquid repellent layer, it is desirable to be less than 5.0 nm, and it is still more desirable especially that Ra is less than 1.0 nm.

In this invention, addition of the condensation product containing hydrolysable silane compound having fluorine-containing group leads to lower surface free energy, and flat surface can be obtained.

To above-mentioned nozzle forming material, it is also possible to use various additive agents together for the purpose of increasing the degree of cross-linking, improvement in photo-sensitivity, prevention of swelling, improvement of coating characteristics, improvement of adhesion power to substrate, giving flexibility, to attain mechanical strength, the higher resistance against chemicals and so on. For example, above-mentioned photo cationic initiator can be used with a reducing agent such as copper (II) trifluoromethanesulfonate, ascorbic acid etc, to attain higher degree of cross-linking. Moreover, in order to prevent swelling and size modification of the nozzle part in ink, it is also useful to add fluorine compound in Japanese Patent Application Laid-Open No. 8-290572. Furthermore, for the purpose of improvement of adhesion power to substrate, addition of coupling agent (ex. Silane compounds) is also effective.

Next, the manufacturing method of an ink-jet head using an above-mentioned nozzle material will be explained.

This invention is suitable for the manufacturing method, which forms a nozzle by pattern-exposure and developing. For example, it is applied to the method which form precise nozzle structure with photo lithography technology using photosensitive material, indicated in Japanese Patent Application Laid-Open Nos. 4-10940 to 4-10942, Japanese Patent Application Laid-Open No. 6-286149, and the Japanese Patent No. 3143307 etc.

For example, the following methods are mentioned. Namely, the method of manufacturing ink jet head comprising:

coating a nozzle material resin on a substrate, forming nozzle plate having ink ejection opening by pattern-exposure and developing of the nozzle material, and adhere the nozzle plate on the substrate having ink ejection pressure generating element.

Another method of manufacturing ink jet head comprising:

forming a ink passage pattern with dissoluble resin material on a substrate having an ink ejection pressure generating element, forming a coating resin later by applying a polymerizable coating resin of this invention as an ink passage wall on the dissoluble resin material layer, forming an ink ejection opening by removing coating resin layer above ink ejection pressure generating element, dissolving the dissoluble resin material pattern, wherein the coating resin layer contains condensation product of hydrolysable silane compound and polymerizable resin composition.

Subsequently, it is explained the example of the ink jet head of this invention.

Figure 2:
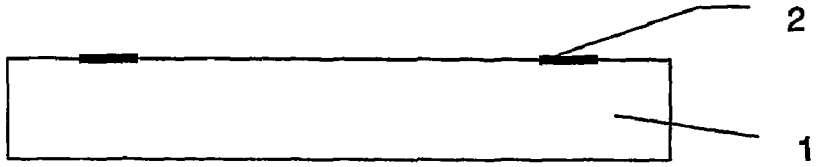
FIG. 2 is a 2-2 sectional view of FIG. 1, showing an initial step of manufacturing the ink jet head of this invention.
Figure 3:
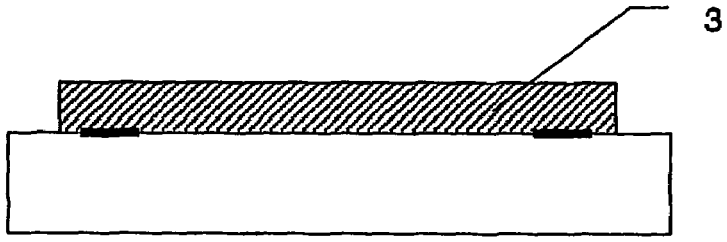
FIG. 3 is a sectional view showing a step for manufacturing the ink jet head of this invention.
Figure 4:
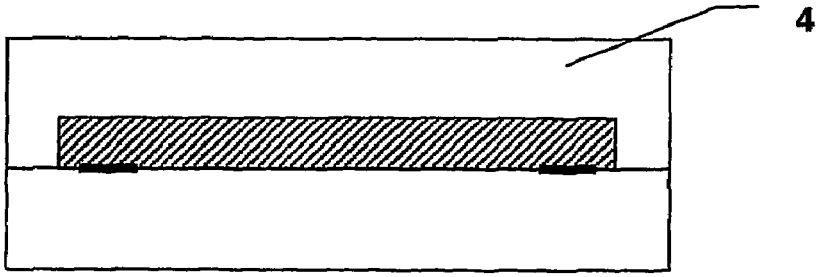
FIG. 4 is a sectional view showing a step for manufacturing the ink jet head of this invention.
Figure 5:
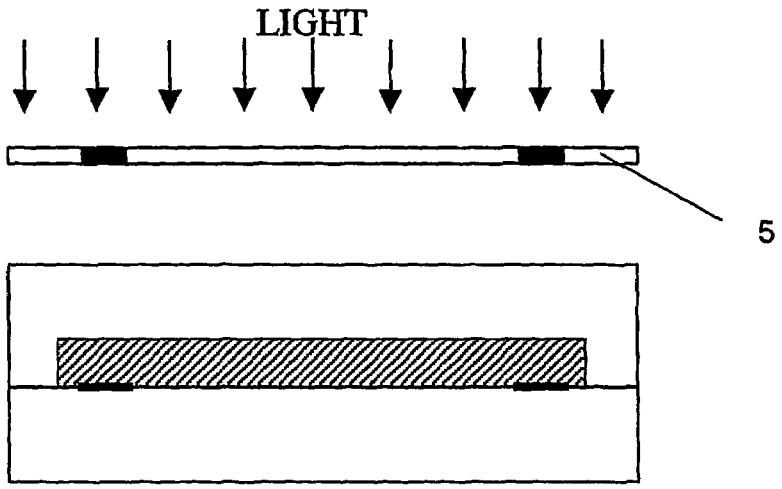
FIG. 5 is a sectional view showing a step for manufacturing the ink jet head of this invention.
Figure 6:
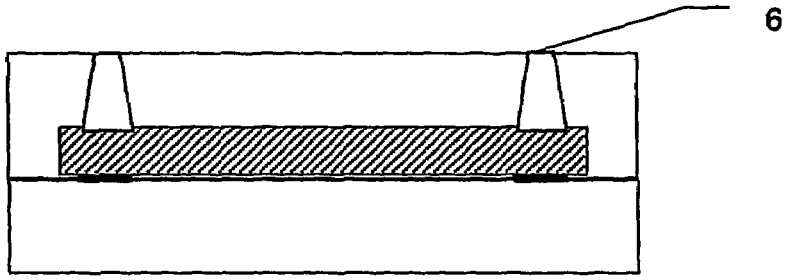
FIG. 6 is a sectional view showing a step for manufacturing the ink jet head of this invention.

FIG. 1 is a perspective view of the substrate 1 having the ink ejection pressure-generating element 2. FIG. 2 is a 2-2 sectional view of FIG. 1. FIG. 3 is a figure of the substrate formed ink passage pattern 3 with dissoluble resin material. It is suitably used a positive type resist, especially a photo-decomposable positive type resist with a comparatively high molecular weight, in order to prevent a collapse of the ink passage pattern during processing of nozzle formation. Subsequently, FIG. 4 shows that the coating resin layer 4 of this invention has arranged on the ink passage pattern. The coating resin layer is polymerizable with light or thermal energy, especially cationic photo-polymerizable. The coating resin layer can be suitably formed by spin coating, direct coating, etc. Subsequently, an ejection opening 6 is formed by a pattern exposure through mask 5, as shown in FIG. 5 and, developed as shown in FIG. 6.

Figure 7:
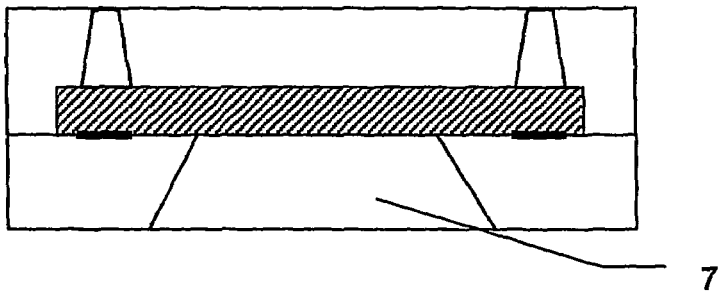
FIG. 7 is a sectional view showing a step for manufacturing the ink jet head of this invention.
Figure 8:
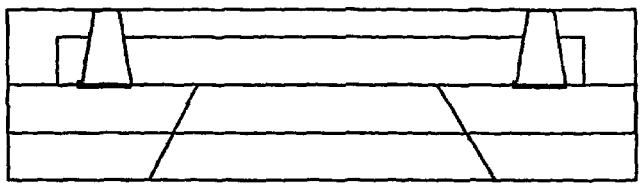
FIG. 8 is a sectional view showing the ink jet head of this invention manufactured by the steps of FIGS. 2 to 7.

Subsequently, an ink supply opening 7 is suitably formed to substrate (FIG. 7), and an ink passage pattern is made to dissolve (FIG. 8). Finally, if needed, heat-treats is applied, thus the nozzle material is cured completely, and an ink jet head is completed.

The coating resin layer of this invention can be applied to a substrate two or more times, in order to obtain desired thickness of coating. In this case, it is indispensable to use above-mentioned coating resin composition as the most upper layer. Regarding lower layer, it is also possible to use above-mentioned coating resin composition and photo-polymerizable resin composition not containing hydrolysable condensation product.

In the nozzle manufacturing process of this invention, a liquid repellent surface is obtained using hydrolysable condensation product containing fluorine atom, without performing a liquid repellent process. Since this liquid repellent nature is obtained at the time of an application and dryness, the liquid repellent nature inside of ejection outlet and ink passage, which formed of subsequent exposure and the development process, can be restrained and does not cause any problem concerning its performance as ink jet head.

This invention has the feature that shows liquid repellency only for the nozzle surface through applying nozzle material on a substrate. Therefore, the mechanical methods, such as molding, laser processing and dry etching etc., can be useful also. In that case, hydrophilic processing is not needed, but it is used suitably.

The nozzle material in this invention has reactive group such as polymerizable and hydrolysable group. Since those reactive groups remain even after pattern-exposure and developing, curing reaction can be promoted with additional light exposure or heat treatment. That additional curing process has positive effect on performance of the material such as adhesive property, ink resistance, wiping durability and so on.

Embodiments

SYNTHETIC EXAMPLE 1

Hydrolysable condensation product was prepared according to the following procedures.

Glycidylpropyltriethoxysilane 28 g (0.1 mol), methyltriethoxysilane 18 g (0.1 mol), trideca fluoro-1, 1, 2, 2-tetrahydroctyltriethoxysilane 6.6 g (0.013 mol, equivalent for 6 mol % in total amount of the hydrolysable silane compound), water 17.3 g, and ethanol 37 g was stirred at room temperature, subsequently refluxed for 24 hours, thus hydrolysable condensation product was obtained.

Furthermore, the condensation product was diluted with 2-butanol and ethanol to 20 wt % as nonvolatile content, and the hydrolysable condensation product was obtained.

Embodiment 1

An ink jet head was produced according to the procedure shown in the above-mentioned method in FIGS. 1 to 8.

At first, the silicone substrate 1 having the electric heat conversion element as ink ejection pressure generating element 2 was prepared, and the dissoluble resin layer was formed by applying polymethyl isopropenyl ketone (ODUR-1010, Tokyo Oka Kogyo Kabushiki Kaisha) by spin coating on the silicone substrate. Subsequently, after prebaking at 120° C. for 6 minutes, pattern exposure of ink passage was performed by mask aligner UX3000 (USHIO Electrical Machinery).

Exposure time was for 3 minutes, and development was carried out with methyl isobutyl ketone/xylene=2/1, and rinsed with xylene.

Said polymethyl isopropeny ketone is the so-called positive type resist, which decomposes and becomes soluble to the organic solvent by UV irradiation. The pattern formed with the dissoluble resin material was the portion which was not exposed in the case of pattern exposure, and became the ink supply passage 3 (FIG. 3). In addition, the thickness of the dissoluble resin material layer after development was 20 micrometers. Subsequently, A cationic photo-polymerizable coating resin shown in Table 1 was dissolved in methyl isobutyl ketone/xylene mixture solvent by 55 wt % as solid content, and applied on the substrate 1 with ink passage pattern 3 of dissoluble resin material layer by spin coating, and prebaking was performed at 90° C. for four minutes. The thickness of the coating resin layer 4 on ink passage pattern was 55 micrometers after repeating this application and prebaking 3 times (FIG. 4).

TABLE 1

Composition 1

| | | |
|---|---|---|
| hydrolysable condensation product | hydrolysable condensation product of synthetic example 1 (20 wt %) | 25 parts |
| Epoxy resin | EHPE-3150 (Daicel Chemical) | 100 parts |
| Additive | 1,4-HFAB (Central Glass) | 20 parts |

TABLE 1-continued

| Composition 1 | | |
|---|---|---|
| photo cationic initiator | SP172, Asahi Denka Industry | 5 parts |
| Reducing agent | copper (II) trifluoromethanesulfonate | 0.5 parts |
| Silane coupling agent | A187 (Nippon Unicar) | 5 parts |

1,4-HFAB: (1,4-bis(2-hydroxyhexafluoroisopropyl)benzene)

Subsequently, pattern exposure of the ink ejection opening was applied using mask aligner "MPA600 super" made by CANON (FIG. 5).

Next, the ejection opening pattern 6 was formed through heating at 90 degrees C. for 4 minutes, developing by methyl isobutyl ketone (MIBK)/xylene=2/3 and performing a rinse with isopropyl alcohol. The coating resin layer was cured by the photo cationic polymerization except the ejection opening pattern, and the ejection opening pattern which had sharp edge was obtained (FIG. 6). Subsequently, mask for forming ink supply opening in the back side of the substrate was arranged suitably, and ink supply opening 7 was formed by anisotropic etching of silicone substrate (FIG. 7). The surface of the substrate having the nozzle was protected by a rubber film during anisotropic etching of silicone. The rubber protective film was removed after completing anisotropic etching, and further the dissoluble resin material layer forming ink passage pattern was decomposed by irradiating UV using said UX3000 on the whole surface again. Subsequently, the ink passage pattern 3 dissolved by immersing into methyl lactate for 1 hour while giving an ultrasonic wave to said substrate. Subsequently, in order to cure the coating resin layer 4 completely, heat treatment was performed at 200 degrees C. for 1 hour (FIG. 8). Finally, an ink jet head was completed by adhering the ink supply member on the ink supply opening.

Embodiment 2

An ink jet head was produced like embodiment 1 except for applying composition 2 shown in Table 2 instead of the composition 1 as underlayer, which application and prebaking were repeated twice, and as the most upper layer above-mentioned composition 1 was applied.

TABLE 2

| Composition 2 | | |
|---|---|---|
| Epoxy resin | EHPE-3150, Daicel Chemical | 100 parts |
| Additive | 1,4-HFAB, Central Glass | 20 parts |
| photo cationic initiator | SP172, Asahi Denka Industry | 5 parts |
| Reducing agent | copper (II) trifluoromethanesulfonate | 0.5 parts |
| Silane coupling agent | A187, Nippon Unicar | 5 parts |

1,4-HFAB: (1,4-bis(2-hydroxyhexafluoroisopropyl)benzene)

Embodiment 3

An ink jet head was made like embodiments, except for using the composition 3 shown in Table 3 instead of the composition 1.

TABLE 3

| Composition 3 | | |
|---|---|---|
| hydrolysable condensation product | hydrolysable condensation product of synthetic example 1 (20 wt %) | 5 parts |
| Epoxy resin | EHPE-3150, Daicel Chemical | 100 parts |
| Additive | 1,4-HFAB, Central Glass | 20 parts |
| photo cationic initiator | SP172, Asahi Denka Industry | 5 parts |
| Silane coupling agent | A187, Nippon Unicar | 5 parts |

1,4-HFAB: (1,4-bis(2-hydroxyhexafluoroisopropyl)benzene)

Embodiment 4

Using the composition 3 shown in Table 3, an ink jet head was produced completely like embodiment 1, except for an application and an prebaking were performed only once, and thickness of the coating resin layer was 20 micrometers of on an ink passage pattern.

<Evaluation of Printing Quality>

The obtained ink jet recording head of Embodiments 1 to was filled up with ink BCI-3Bk (Canon) and printing was carried out. And the highly quality image was obtained.

<Evaluation of Wiping Durability>

When printing again after performing wiping operation 30000 times with the HNBR rubber blade while spraying ink for the nozzle surface of this ink jet head, the same high-quality image as before wiping could be obtained. Thus wiping durability was proved to be excellent.

<Preservation Property>

Furthermore, after this ink jet head was filled up with the above-mentioned ink, preserved at 60 degrees C. for two months. The printing quality was the same as before preservation.

<Evaluation of Liquid Repellency>

Moreover, both values of advancing and receding contact angle against ink BCI-3Bk for an ink jet head was high. And liquid repellency was excellent (Table 4).

<Surface Roughness>

The surface roughness of this ink jet head was measured in contact mode using scanning probe model microscope JSPM-4210. The surface roughness is Index Ra was 0.2 to 0.3 nm (it scans on 10-micrometer square), and the surface of this nozzle material was confirmed to be very flat and smooth (Table 4).

<Elementary Analysis of Surface>

Furthermore, surface analysis by ESCA (Electron Spectroscopy for Chemical Analysis) was performed with the measurement angle of 6 degrees by Quantum 2000 (Ulvac-phi).

When the ratio of four elements of C, O, Si, and F is measured, it was observed that F atom was arranged on the surface at higher content than the calculated value 6 atom % (Table 4).

TABLE 4

| | (Evaluation result) | | | |
|---|---|---|---|---|
| | Embodiment 1 | Embodiment 2 | Embodiment 3 | Embodiment 4 |
| Printing quality (First stage) | good | good | good | good |
| Printing quality (after wiping) | good | good | good | good |
| Printing quality (After a preservation) | good | good | good | good |
| Advancing contact angle | 83 | 83 | 87 | 87 |
| Receding contact angle | 57 | 55 | 63 | 62 |
| Surface roughness Ra/nm | 0.3 | 0.4 | 0.3 | 0.2 |
| Surface fluoride atom ratio/atom % | 32 | 32 | 38 | 38 |

The invention claimed is:

1. An ink jet head, comprising:

an orifice plate portion including an ink ejection opening penetrating the orifice plate portion from an inlet side to an outlet side; and a substrate including an energy generating element for generating energy used for discharging ink from the ink ejection opening, the energy generating element facing the inlet side of the ink ejection opening, wherein said orifice plate portion is formed entirely of a cured product obtained from a material comprising a composition comprising a polymerizable resin having an epoxy group or an oxetanyl group and a condensation product of a hydrolysable silane compound having a fluorine-containing group and a hydrolysable silane compound having an epoxy group or an oxetanyl group, and wherein a first surface of said orifice plate portion containing the inlet side of the ink ejection opening has a lower liquid repellency than a second surface of said orifice plate portion containing the outlet side of the ink ejection opening.

2. An ink jet head according to claim 1, wherein the polymerizable resin is an epoxy compound that is solid at room temperature.

3. An ink jet head according to claim 1, wherein the condensation product is a condensation product of a hydrolysable silane compound having a fluorine-containing group, a hydrolysable silane compound having an epoxy group or an oxetanyl group and a hydrolysable silane compound selected from a silane having at least one alkyl substituent, a silane having at least one aryl substituent or a silane having four hydrolysable substituents.

4. An ink jet head according to claim 1, wherein the hydrolysable silane compound having a fluorine-containing group has three hydrolysable substituents.

5. An ink jet head according to claim 4, wherein the hydrolysable silane compound selected from a silane having at least one alkyl substituent, a silane having at least one aryl substituent or a silane having no non-hydrolysable substituent is represented by general formula (3):

$$R_aSiX_{(4-a)} \quad (3)$$

wherein R is a non-hydrolysable substituent selected from substituted or unsubstituted alkyl groups and substituted or unsubstituted aryl groups, X is a hydrolysable substituent, and a is an integer from 0 to 3.

6. An ink jet head according to claim 1, wherein the hydrolysable silane compound having a fluorine-containing group is represented by general formula (1):

$$R_fSi(R)_bX_{(3-b)} \quad (1)$$

wherein $R_f$ is a non-hydrolysable substituent having 1 to 30 fluorine atoms bonded to a carbon atom, R is a non-hydrolysable substituent, X is a hydrolysable substituent, and b is an integer from 0 to 2.

7. An ink jet head according to claim 6, wherein the non-hydrolysable substituent $R_f$ has at least 5 fluorine atoms bonded to a carbon atom.

8. An ink jet head according to claim 6, wherein the condensation product is a condensation product of at least two hydrolysable silane compounds having a fluorine-containing group, the silane compounds having a different number of fluorine atoms contained therein.

9. An ink jet head according to claim 1, wherein the hydrolysable silane compound having an epoxy group or an oxetanyl group is represented by general formula (2):

$$R_cSi(R)_bX_{(3-b)} \quad (2)$$

wherein $R_c$ is a non-hydrolysable substituent having a cationic polymerizable group, R is a non-hydrolysable substituent, X is a hydrolysable substituent, and b is an integer from 0 to 2.

10. An ink jet head according to claim 1, wherein the molar ratio of the hydrolysable silane compound having a fluorine-containing group is 0.5 to 20 mol %, based on the total amount of hydrolysable compounds.

11. An ink jet head according to any of claims 1, 2, 3, 4, and 6-10, wherein the mixing ratio (A):(B) by weight of (A) the condensation product of a hydrolysable silane compound having a fluorine-containing group and (B) the composition is from 0.001:1 to 1:1.

12. ink jet head according to claim 1, wherein said substrate and said orifice plate portion are bonded to be in contact with each other.

* * * * *